United States Patent [19]

Berger et al.

[11] 4,148,957

[45] Apr. 10, 1979

[54] WOVEN BELTING WITH TUBULAR EDGE PORTIONS

[76] Inventors: Johann Berger; Josef Berger, both of Obere Schlohstrasse 114, 7071 Alfdorf, Fed. Rep. of Germany

[21] Appl. No.: 865,112

[22] Filed: Dec. 28, 1977

[30] Foreign Application Priority Data

Dec. 31, 1976 [DE] Fed. Rep. of Germany ..... 2659789

[51] Int. Cl.[2] ..... B32B 3/02

[52] U.S. Cl. ..... 428/193; 28/143; 28/166; 139/383 R; 428/36; 428/192; 428/257; 428/258

[58] Field of Search ..... 428/36, 192, 193, 257, 428/258; 139/383 R, 387 R; 28/143, 166

[56] References Cited

U.S. PATENT DOCUMENTS

| | | | |
|---|---|---|---|
| 2,194,038 | 3/1940 | Wallace | 139/387 R |
| 4,018,960 | 4/1977 | Berger et al. | 418/36 |

*Primary Examiner*—James J. Bell

*Attorney, Agent, or Firm*—Cushman, Darby & Cushman

[57] ABSTRACT

A woven belting has a single-ply central portion and tubular edges which are integrally woven with the central portion as a hollow plain weave; high abrasion resistance is achieved for the tubular edges by shrinking their warp threads to a predetermined extent before the weaving operation. The warp threads in the edges of the belting are subsequently shrunk to their full possible extent during a final heat setting treatment of the whole belting.

3 Claims, No Drawings

WOVEN BELTING WITH TUBULAR EDGE PORTIONS

BACKGROUND AND BRIEF DESCRIPTION OF THE INVENTION

This invention relates to woven safety belting and a method of manufacturing same of the kind having a single-ply central portion and tubular edge portions which are woven in a hollow plain weave integrally with the central portion.

Such belting is generally known from Belgian Patent Specification 834,013. (See also U.S. Pat. No. 4,018,960).

It is known that belting is heat-set after it has been woven. By this heat-setting, the desired reference elongation of the belting, lying between 5 and 20%, is achieved. According to the prior art such as the above-mentioned Belgian Patent, in order to impart a higher elongation at break to the warp threads in the tubular edge portions of the belting than to the warp threads of the central portion, the elongations at break should differ by only a small percentage.

In the prior art belts, it has been known that there was a lack of adequate abrasion resistance.

This lack of abrasion resistance was encountered almost only at the tubular edge portions, with scarcely any being apparent in the central portion. Thus, when an overload was exerted, the abraded belting was torn beginning at the edges. As a result, a belting strap which had been used for a longer time was torn under an appreciably lower load than a new belting strap.

In abrasion tests, it has been found that the warp threads of the tubular edge portions of a belt tend to exhibit an additional shrinkage under the influence of the heat generated by abrasion during use. As a result, the belting tends to warp about its longitudinal axis in such a manner that the object being held by the belt was engaged only by the two tubular edge portions while the central portion was curved or warped away from the object being restrained by the belt. As a result, wear of the threads was restricted almost exclusively to the tubular edge portions while the central portion was not worn.

This disadvantage is eliminated according to the present invention by a belt structure having the single-ply portion integrally provided with the hollow-weave tubular edge portions and where the warp threads in such edge portions have been set with a higher elongation at break than the warp threads of the central portion. Specifically, the edge portions of the belting, according to the present invention, include warp threads having a preliminary shrinkage v defined as follows:

$$v \approx m - f$$

wherein m = the maximum possible shrinkage of the warp threads in the tubular edge portions, f = the additional shrinkage exhibited by heat-setting of the entire belting and $\approx$ means "almost equal to".

After heat-setting, there is obtained a belt in which the tubular edge portions have been shrunk to the maximum possible extent. This is accomplished in the warp threads which are used in the tubular edge portions by shrinking them before the weaving operation by a differential extent which corresponds at least approximately to the difference between the maximum possible shrinkage and the final shrinkage which is caused by the heat setting of the entire belt. As a result, the heat generated by any subsequent abrasion or rubbing cannot result in an additional shrinkage so that the belting strap will wear uniformly throughout its width and thus enjoy a longer life span than conventional belting.

The present invention also provides a method for manufacturing an improved safety belt wherein the warp threads for the tubular edge portions are shrunk to a predetermined extent before weaving and are later fully shrunk during heat setting of the belt structure.

As a specific example of a belting structure manufactured according to the present invention, the following is given.

Polyester yarns of the type identified by the registered trademark "Trevira", consisting of 100 filaments and having a fineness grade of 1,100 DTEX, 100 Z-turns per meter, and a shrinkage of about 13% are used. The shrinkage values are stated herein in percent of the net length so that a shrunk thread portion can be stretched by that percentage, for example, by 13%.

The tubular edge portions may also be constructed from polyester yarns sold under the trademark "Trevira" and consisting of 50 filaments and having a fineness grade of 550 DTEX, 130 Z-turns per meter and a shrinkage of about 21%.

The central portion of the belting contains 390 warp threads and each tubular edge portion contains 16 warp threads. The pick count is 92 picks per 10 cm. The tubular edge portions are woven in a tubular plain weave.

Before weaving, the yarns are subjected to preliminary tests to determine their maximum possible shrinkage. When it amounts to, for example, 40% and the entire belting should be shrunk 8% by final heat-setting, the warp threads for the tubular edge portions are shrunk 32% by heat treatment before they are woven. The warp threads for the central portion are woven with a shrinkage of for example 13% which is the shrinkage the yarn has as it is received from the manufacturer. Finally, the woven belting is shrunk 8% when treated on the heat-setting apparatus. The resulting belting has in its central portion a shrinkage of about 21% and has tubular edge portions which have been shrunk to the full possible extent. The heat-setting steps may be carried out on any conventional apparatus.

Having described the invention, it will be obvious that modifications may be made therein without departing from the spirit and scope of the invention as defined in the appended claims.

What is claimed is:

1. Belting made from a fabric comprising interwoven warp and weft threads defining a single-ply central portion and tubular edge portions integrally attached on each side of said central portion, the warp threads in each edge portion having, after heat-setting, a higher elongation at break than the warp threads in said central portion and said warp threads in said edge portions, prior to being woven, having been subjected to a preliminary shrinkage $$v \approx m - f,$$

wherein m = the maximum possible shrinkage of said warp threads in said edge portions, f = the additional shrinkage exhibited by said fabric as it is heat-set and $\approx$ means "almost equal to", said warp threads in said edge portions having been shrunk to substantially their maximum extent upon said heat-setting of said fabric.

2. A process of making a belting fabric having a single-ply central portion and tubular edge portions woven from warp and weft threads, the steps comprising subjecting the warp threads to be used in said tubular edge portions, prior to weaving said tubular edge portions, to a heat treatment in order to shrink them by an amount $v \approx m - f$, weaving said warp threads into said tubular edge portions of said fabric, and, then, subjecting the entire fabric comprising said central portion and said tubular edge portions to a heat treatment during which the warp threads of said tubular edge portions are shrunk to their maximum possible extent, and wherein m = the maximum possible shrinkage of said warp threads in said tubular edge portions, f = the additional shrinkage exhibited by said fabric as it is heat-set, and $\approx$ means "almost equal to".

3. A woven belting fabric produced by the process of claim 2.

* * * * *